7/15/80 XR 4,213,029

United States Patent [19]

Endicott, Jr. et al.

[11] 4,213,029

[45] Jul. 15, 1980

[54] RADIATION TRANSMISSIVE HOUSING HAVING A HEATED LOAD BEARING GASKET

[75] Inventors: Donald L. Endicott, Jr., San Diego; Jerry D. Stachiw, El Cajon, both of Calif.

[73] Assignee: The United States of America as represented by the Secretary of the Navy, Washington, D.C.

[21] Appl. No.: 13,719

[22] Filed: Feb. 21, 1979

[51] Int. Cl.[2] ..... H05B 1/00

[52] U.S. Cl. ..... 219/209; 114/340; 219/203; 219/522; 343/704; 343/872; 350/319

[58] Field of Search ..... 219/203, 209, 522, 213; 114/340; 350/319; 343/704, 872

[56] References Cited

U.S. PATENT DOCUMENTS

| | | | |
|---|---|---|---|
| 1,885,127 | 11/1932 | Milette et al. | 219/203 X |
| 2,858,408 | 10/1958 | Barroero | 219/522 |
| 3,495,259 | 2/1970 | Rocholl et al. | 219/203 X |
| 3,553,432 | 1/1971 | Livingston et al. | 219/203 |
| 3,558,220 | 1/1971 | Werner | 350/319 |
| 3,611,970 | 10/1971 | Hagan et al. | 350/319 |
| 3,805,017 | 4/1974 | Roberts et al. | 219/213 |
| 3,807,791 | 4/1974 | Boyer | 219/203 |
| 3,951,301 | 4/1976 | Meginnis | 350/319 |
| 3,989,360 | 11/1976 | Duchet | 350/319 |
| 4,150,875 | 4/1979 | Stachiw et al. | 350/319 |

*Primary Examiner*—C. L. Albritton
*Attorney, Agent, or Firm*—Richard S. Sciascia; Ervin F. Johnston; James O. Skarsten

[57] ABSTRACT

Apparatus for protectively housing radiation transmitting or receiving equipment is provided with a window in the form of a spherical segment, which is formed of material transmissive to radiation of the frequencies of the equipment, and which has a seating surface. A mounting for providing forces to support the window and to resist external pressure applied thereto has a bearing surface, and a heated bearing gasket abutts both the bearing and seating surfaces. The gasket is provided for resisting wear between the bearing and seating surfaces, and also for transferring selected amounts of heat to the window. A heat regulator is coupled between the window and the gasket to control the amount of heat transferred to the window by the gasket, and structure is provided for continuously joining the window, the mounting and the gasket.

13 Claims, 9 Drawing Figures

RADIATION TRANSMISSIVE HOUSING HAVING A HEATED LOAD BEARING GASKET

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention disclosed and claimed herein generally pertains to housing apparatus which includes a window or lens which must be transmissive to radiation of selected frequency, wherein it is necessary to regulate the temperature of the window to prevent the formation of ice or water deposits thereupon. More particularly, the invention pertains to such housing apparatus wherein the window comprises a spherical segment and is heated by a bearing gasket, the bearing gasket being capable of withstanding extremely high temperatures and compression forces. Even more particularly, the invention pertains to such apparatus for housing optical or infrared sensing equipment in a marine environment.

It has been found that a window having the shape or configuration of a spherical segment, such as a hyperhemisphere, may be very usefully employed in a submarine periscope housing for protecting optical or infrared image sensing equipment. By employing a spherical segment window in such a housing, various advantages have been realized, such as improved viewing capability and reduced resistance to motion through water. A periscopic housing which employs a hyperhemispherical window has been successfully designed, fabricated and tested, and is disclosed in a Patent Application of Jerry D. Stachiw and George M. Horn for a "Pressure Resistant Housing," filed 23 Sept. 1977, Ser. No. 836,255, a communication indicating the allowance of the application having been mailed from the Patent and Trademark Office on 29 Dec. 1978.

In a housing for protecting infrared viewing or sensing equipment, the window for the housing is usually formed for germanium, which is highly transmissive to radiation in the infrared frequency range. If such a housing is to be used in a frigid marine environment, such as the Arctic Ocean, the problem of ice formation on the external surface of the window is encountered, especially when the window is near the seawater-air interface, and is repeatedly subjected to exposure to Arctic winds and submersions in near freezing seawater. The problem of ice formation is very significant, since water and ice coatings are impenetrable barriers to radiation of infrared frequencies.

Current techniques for heating germanium windows employed in high altitude applications, such as in aircraft infrared sensory equipment, use the resistivity of the germanium by applying an electric potential or voltage directly to the window. However, in a seawater environment, the direct application of electric potential to a germanium window would result in electrolysis of the window, whereby the window would be severly corroded. Consequently, infrared sensing equipment for marine applications is currently restricted to operation in temperature waters. As far as is known, no infrared viewing or sensing equipment is available for operating in a frigid or Arctic marine environment.

In the above-referenced Pressure Resistant Housing, a germanium or glass hyperhemispherical window, provided with a seating surface, is sealably joined to the bearing surface of a mounting or base. A germanium window is used when the housing contains infrared sensing equipment, and a glass window is used when the housing contains equipment for sensing optical images. A gasket of elastic material is positioned between the seating and bearing surfaces in order to resist wear therebetween, particularly lateral wear. All of the forces required to support the window and to resist external pressure thereupon are provided by the mounting and must be transferred through the gasket. If the housing is employed as part of a submarine periscope system, external pressure on the window may exceed several thousand psi when the submarine is submerged, whereupon the gasket is subjected to extreme compressive force.

It has been considered that in the above type of housing, a germanium or glass window could be maintained at a temperature above the freezing point of water by enclosing an electric heating element in the gasket of the housing. The gasket would be heated by the electric element, and heat transferred to the window therefrom by the process of heat conduction. However, it would be necessary to structure such a heating element-bearing gasket combination so that the heating element would not be crushed or damaged by the extreme compressive forces upon the gasket, or by lateral motion of the window seating surface with respect to the mounting bearing surface. Also, it is anticipated that in order to maintain the external surface of a germanium or glass hyperhemispherical window at a temperature of 30° F.–40° F. in a frigid environment, it could be necessary to heat the gasket to a temperature in excess of 200° F. Repeated heating of the gasket to such extent could seriously reduce or destroy its elastic properties. This could be very serious if the gasket was used in a housing for a submarine periscope system. In such a system, in addition to resisting wear between the mounting and the window, an elastic gasket is required to provide compensation for the very different flexure rates of the mounting and window as they are subjected to varying amounts of hydrostatic pressure. The different flexure rates result from the construction of the mounting from a metal such as titanium, whereas the window is formed from a brittle material such as germanium or glass.

SUMMARY OF THE INVENTION

In the present invention, housing apparatus is provided which includes a window comprising a spherical segment formed of material which is transmissive to radiation of selected frequencies, the window having a seating surface. The invention further includes mounting means for providing forces to support the window and to resist external pressure applied to the window, the mounting means having a bearing surface for transmitting the supporting and pressure resisting forces. A heated bearing gasket means abutting the bearing surface and also abutting the seating surface is provided, the gasket means for transferring the supporting and pressure resisting forces from the bearing surface of the mounting means to the seating surface of the window, and also for transferring selected amounts of heat to the window. Heat regulating means coupled between the window and the gasket means control the amount of heat transferred to the window, and holding means are provided to maintain the window, the mounting means and the gasket means in joined relationship.

Preferably, the housing apparatus is employed to house equipment for viewing either infrared or optical images, and the heated bearing gasket means comprises a load bearing gasket formed of selected elastic material for resisting wear between the bearing and seating surfaces. The gasket has a first surface in abutting relationship with a frustoconical bearing surface, and a second surface in abutting relationship with a frustoconical seating surface. Electric heating element means enclosed within the gasket and coupled to the regulating means are provided for selectively heating the gasket. Thermometric means coupled to a surface of the window provides a thermometric output which represents the temperature of the external surface of the window, and a thermostatically controlled voltage source receiving the thermometric output couples an electric current to the electric heating element to maintain the external surface of the window at a temperature within a selected temperature range.

In a preferred embodiment of the invention, the gasket is formed of a first gasket component abutting the frustoconical bearing surface and a second gasket component abutting the frustoconical seating surface. Both gasket components are formed of silicone rubber reinforced with fiberglass, and the electric heating element is enclosed or sandwiched therebetween. The electric heating element comprises a selectively shaped strip of electrically conductive material, each end thereof being coupled to the voltage source, and there being a specified voltage drop thereacross. The window of the preferred embodiment comprises a hyperhemispherical window, and the mounting means is formed of a selected metallic material.

The above embodiment may be used in a submarine infrared or optical viewing system, the window being formed of germanium or glass, and capable of being employed in a frigid marine environment. The housing of the embodiment is capable of withstanding external pressures in excess of several thousand psi, and the gasket thereof may be repeatedly heated to temperatures on the order of 200° F. without losing any significant amount of elasticity. However, it is by no means intended to limit the scope of the invention to such embodiment.

OBJECTS OF THE INVENTION

An object of the present invention is to provide improvements in housing apparatus of the type which includes a window in the form of a spherical segment, wherein the external surface of the window must be maintained at a temperature that will prevent the formation of water or ice deposits thereupon, and wherein the housing is repeatedly subjected to external pressures on the order of several thousand psi.

Another object is to provide housing apparatus of the above type, wherein the window is heated by enclosing an electric heating element in a load bearing gasket adjacent to the window, substantial load bearing and pressure resisting forces being transmitted through the gasket and the electric heating element.

Another object is to provide housing apparatus of the above type for use in a marine environment, wherein the window comprises a germanium or glass hyperhemisphere supported by a metallic mounting, and wherein the gasket, located between a seating surface of the window and a bearing surface of the mounting, must maintain a specified degree of elasticity to resist lateral wear between the surfaces, the lateral wear resulting from sliding motion between the surfaces as external pressure on the housing apparatus varies from atmospheric pressure to pressures generated by submersion to many thousand feet of water.

Another object is to provide housing apparatus for infrared or optical viewing equipment, which includes a hyperhemispherical germanium or glass window, respectively, and which is capable of being used in a frigid marine environment.

Another object is to provide housing apparatus for infrared or optical viewing equipment which is to be employed as part of a periscope system for a submarine, and which is to be capable of operation in a frigid marine environment.

These and other objects of the invention will become more readily apparent from the ensuing specification when taken together with the drawings.

DESCRIPTION OF THE PREFERRED EMBODIMENT

Figure 1:
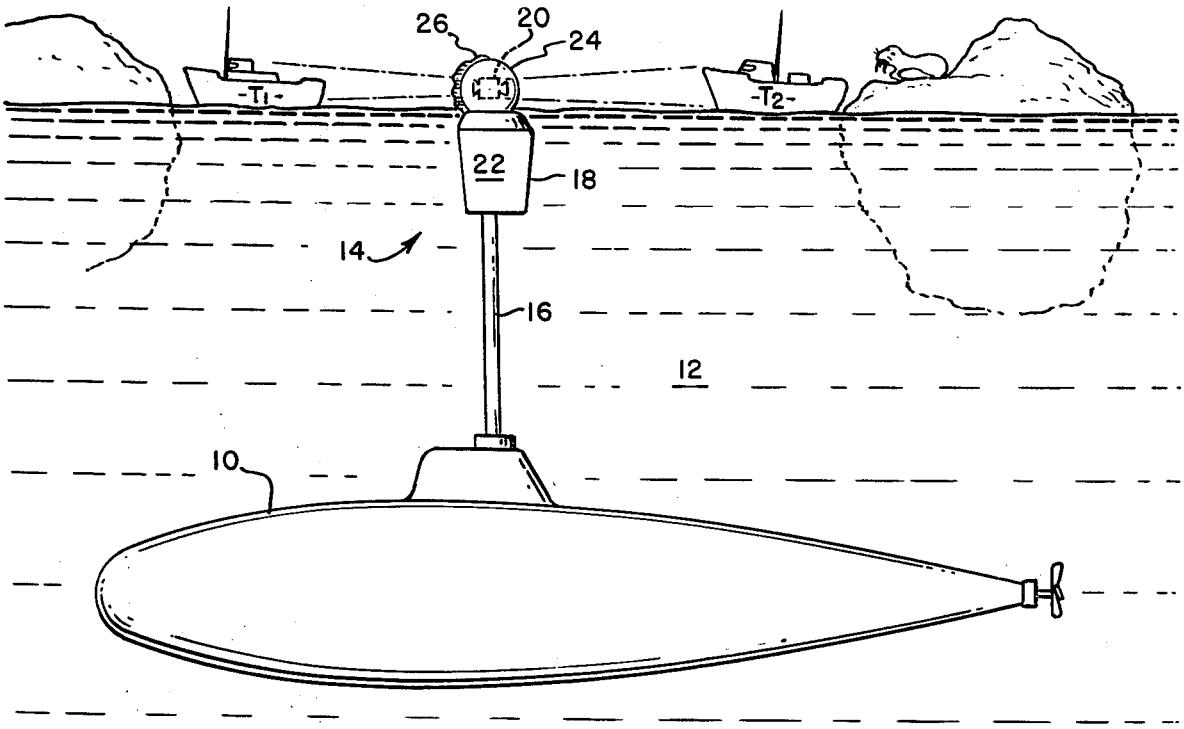
FIG. 1 is a perspective view showing an embodiment of the invention employed as part of the periscope system of a submarine operating in a frigid marine environment.

Referring to FIG. 1, there is shown a submarine 10 operating in a frigid marine environment 12, such as the Arctic Ocean, in proximity to targets $T_1$ and $T_2$, both of which project heat images, or images in the infrared frequency range. Submarine 10 is provided with a periscope system 14 which includes a mast 16 supporting a housing 18 which encloses infrared image sensing equipment 20. Housing 18 includes a mounting or base 22, formed of a metallic material, and a hyperhemispherical window 24 sealably joined to the mounting, window 24 being formed of germanium or other material which is transmissive to infrared frequencies. Housing 18 is described in greater detail hereinafter, and may very usefully comprise the Pressure Resistant Housing disclosed in the above-referenced allowed patent application.

FIG. 1 shows housing 18 situated at the sea-water-air interface of environment 12, whereby a substantial layer of the ice 26 will form on the external surface of window 24, if some means for heating the window is not provided. Ice formation 26 is shown on window 24 to illustrate that ice will prevent sensor 20 from viewing an infrared image of target $T_1$ through the ice. On the other hand, an infrared image of target $T_2$, which is not blocked by a deposit of ice, is viewed by sensor 20.

In a modification of the embodiment of FIG. 1, window 24 is formed of glass or other material transmissive to visible light frequencies, and equipment 20 comprises an electro-optical image sensor. In a further modification, equipment 20 comprises a light beacon or other device for transmitting radiation of selected frequency.

Figure 2:
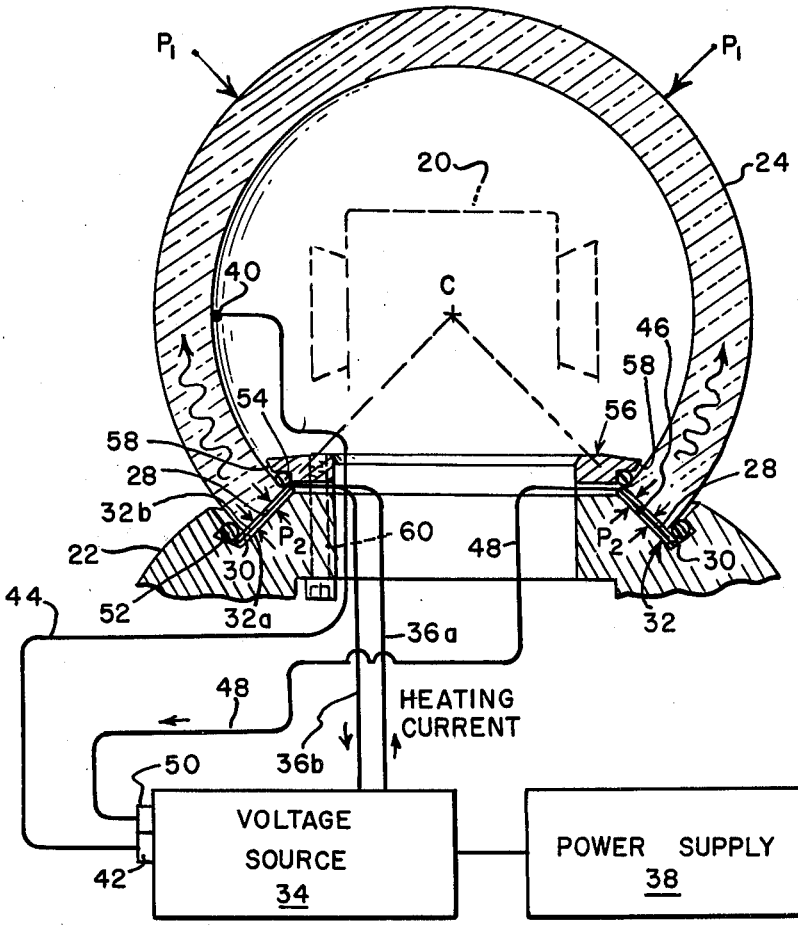
FIG. 2 is partially a sectional view and partially a block diagram showing the embodiment of FIG. 1.

Referring to FIG. 2, there is shown hyperhemispherical window 24 and mounting 22 joined together, along a seating surface 28 of window 24 and a bearing surface 30 of mounting 22. The joint between surfaces 28 and 30 lies on a solid angle having its apex at the center C of hyperhemispherical window 24, whereby seating surface 28 and bearing surface 30 are both frustoconical. That is, both surfaces have the shape of the outer surface of a conical section which is derived by passing spaced apart planes through a cone at right angles to the axis thereof. FIG. 2 further shows a gasket 32 interposed between seating surface 28 and bearing surface 30, gasket 32 being shaped to conform to the frustoconical nature of the surfaces. Gasket 32 comprises a first component 32*a* which abutts bearing surface 30 and a second gasket component 32*b* which abutts seating surface 28, both gasket components being formed of an elastic material such as silicone rubber reinforced with fiberglass.

It will be readily apparent that all of the force required to support hyperhemispherical window 24 must be provided by mounting 22, and must be transmitted from bearing surface 30 to seating surface 28 through gasket 32. In addition, when submarine 10 is submerged, window 24 is subjected to hydrostatic pressure $P_1$, which may exceed several thousands of psi, depending on the depth of submergence. The force required to resist this pressure is also provided by bearing surface 30 of mounting 22, whereby gasket 32 is repeatedly subjected to substantial compressive force $P_2$. However, despite its subjection to extreme compression, it is very important that gasket 32 retain a minimum degree of elasticity in order to resist wear, particularly lateral wear, between the seating and bearing surfaces, and also to compensate for the different flexure rates of the mounting and the window, as aforementioned.

Lateral wear results from sliding motion between the seating and bearing surfaces as the external pressure on window 24 varies. Since the range of variation may be from atmospheric pressure at the air-sea interface of environment 12 to hydrostatic pressure in excess of several thousand psi, the forces which cause the sliding or lateral motion may be very great. Consequently, if gasket 32 does not maintain a high degree of elasticity to protect the two surfaces from lateral wear therebetween, the seating surface of window 24 may be seriously abraded and severely damaged.

In order to maintain the external surface of germanium window 24 at a temperature within the range 30° F.–40° F., to prevent ice formation thereupon, a 500 Watt electric heating element, which is shown in subsequent figures, is enclosed or sandwiched between gasket components 32*a* and 32*b*. The electric heating element is coupled to a 110 volt voltage source 34 through leads 36*a* and 36*b*, whereby a current is coupled to the heating element. Power for voltage source 34 is provided by a power supply 38.

When current is coupled to the electric element enclosed in gasket 32, the gasket is heated and heat is transferred therefrom to window 24 by the process of heat conduction. A temperature probe 40, such as a standard thermocouple, is joined to the internal surface of window 24 to monitor the temperature thereof, the output of thermocouple 40 being coupled to a thermostatic control 42 through lead 44. Thermostatic control 44 regulates voltage source 34, and is set to provide current to the heating element in gasket 32 as long as the temperature sensed by thermocouple 42 is below a predetermined critical temperature. The critical temperature is the temperature of the inner surface of window 24 when the outer surface thereof is in the aforementioned range 30° F.–40° F.

An additional thermocouple device 46 is imbedded in or adjacent to gasket 32 and is coupled through a lead 48 to a safety thermostatic control 50, which also regulates the operation of voltage source 34. Thermostatic control 50 is adjusted so that the heating current provided by voltage source 34 will be turned off whenever the temperature of the gasket rises above an upper gasket temperature limit, which is on the order of 200° F. The safety thermostatic control is provided to prevent gasket 32 from over heating, and possibly burning up, when gasket 32 receives current by error when being employed in a non-frigid environment.

Referring once more to FIG. 2, there is shown window 24, gasket 32 and mounting 22 joined together by means of an external O-ring 52, an internal O-ring 54 and a split ring 56. External O-ring 52 is formed of compliant material and is compressed between mounting 22 and the external surface of window 24 in proximity to the joint therebetween, and internal O-ring 54, also formed of compliant material, is compressed between the internal surface of window 24 and split ring 56 in proximity to the joint between the window and the mounting. Split ring 56 has an outside edge 58 which is shaped and dimensioned to match the inside curvature and inside dimensions of the hyperhemispherical window in proximity to the joint, and is secured to mounting 22 by means of bolts 60 to compress both of the O-rings. The compressed O-rings provide a very tight seal, which is capable of resisting pressures external to window 24 which are on the order of several thousand psi.

It will be noted that in addition to heating window 24, heated gasket 32 prevents external O-ring 52 from freezing, and prevents the small space between window 24, mounting 22, and O-ring 52 from becoming filled with ice when housing 18 is at the surface of environment 12. O-ring 52 must remain compliant, and the space must remain ice-free, so that lateral motion between the window and the mounting can occur if the housing is subsequently submerged.

Figure 3:
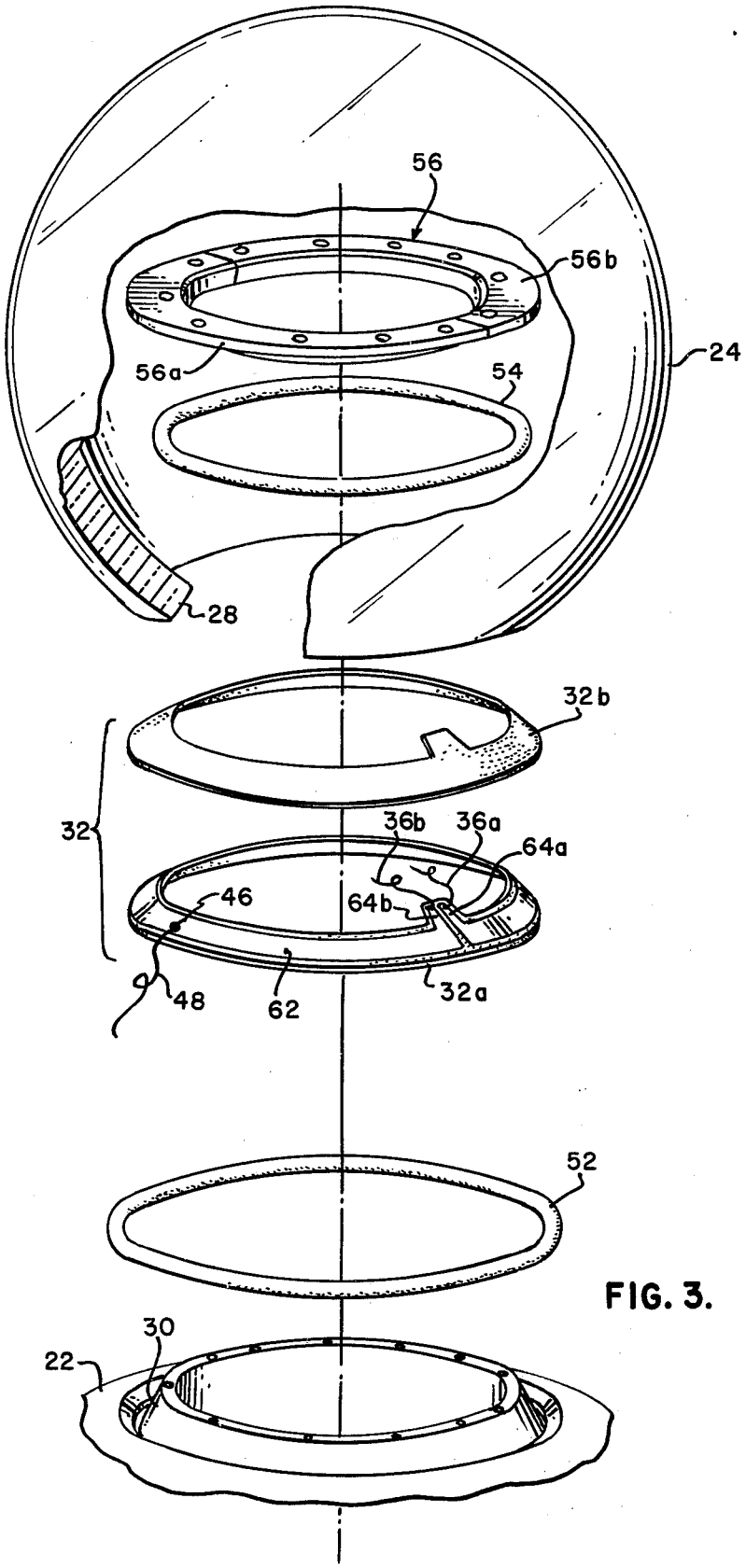
FIG. 3 is an exploded perspective view of the embodiment of FIG. 1, a portion thereof being broken away.

Referring to FIG. 3, there are shown flat annular gasket components 32*a* and 32*b*, each having a surface matching the shape of bearing surface 30 and heating surface 28, respectively, and also having surfaces which match one another. An electric heating element 62, comprising a thin strip of metal foil, is affixed to the upper surface of gasket component 32*a* by means of photo etching or other conventional process available in the field of flexible heater technology. While heating element 62 is shown in FIG. 3 to be an annular strip, it may have any other suitable configuration required to provide a selected resistance between its input and output terminals, comprising heater tabs 64*a* and 64*b*, coupled to leads 36*a* and 36*b*, respectively. Metal strip 62 may be usefully configured or dimensioned to have resistance capable of providing a power density of 32 watts per square inch.

Each of the gasket components 32*a* and 32*b* is usefully formed of silicone rubber material which is reinforced by fiberglass. FIG. 3 further shows thermocouple 46 joined to strip 62, and shows split ring 56 comprising ring components 56*a* and 56*b*.

Figure 4:
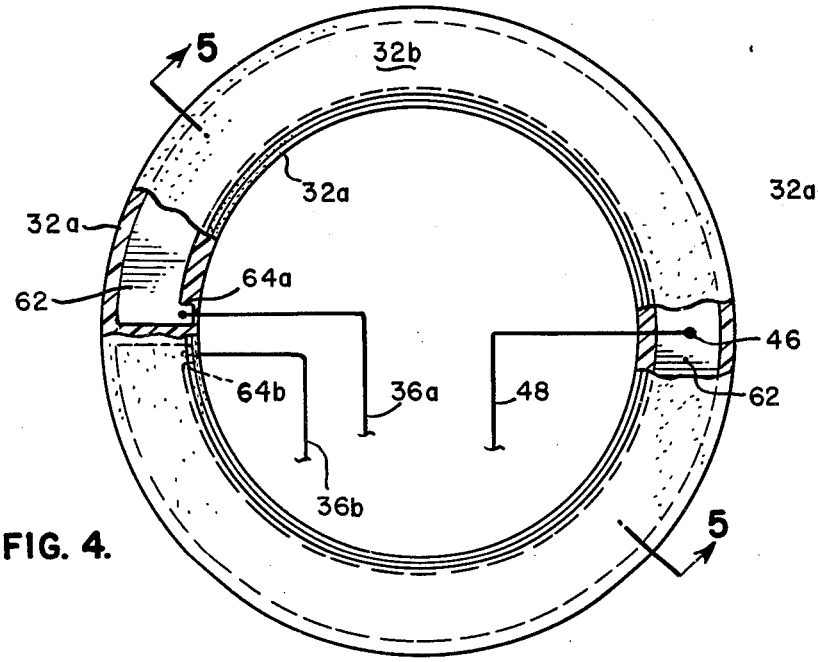
FIG. 4 is a plan view of the embodiment of FIG. 1.
Figure 6:
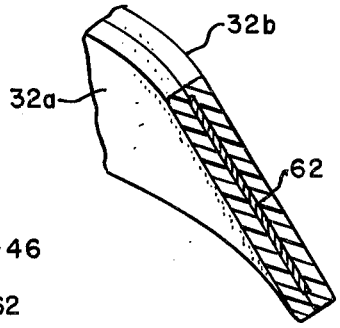
FIGS. 5–6 are cross-sectional views of the gasket of the embodiment of FIG. 4, FIG. 5 being taken along lines 5—5 of FIG. 4.
Figure 5:
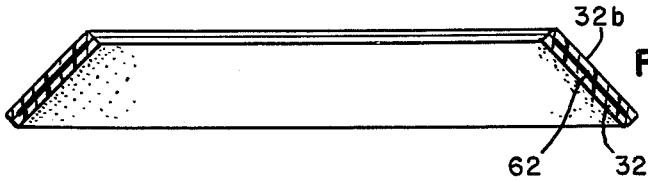

Referring to FIGS. 4–6, there are shown gasket components 32*a* and 32*b* joined together or bonded by means of a selected adhesive.

Figure 7:
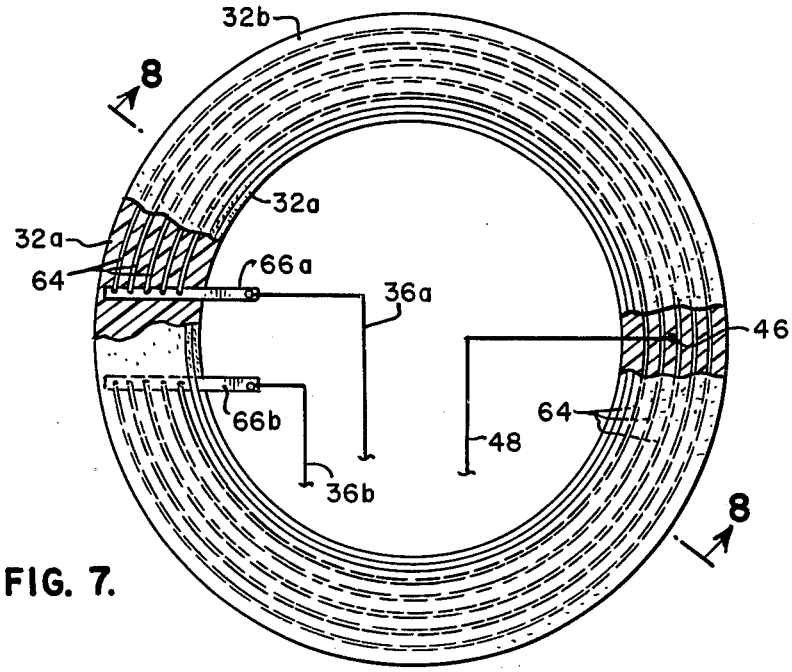
FIG. 7 is a plan view of a modification of the embodiment of FIG. 1.
Figure 9:
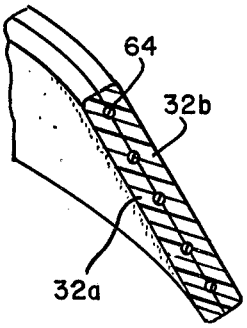
FIGS. 8–9 are cross-sectional views of the gasket of the modification of FIG. 7, FIG. 8 being taken along lines 8—8 of FIG. 7.
Figure 8:
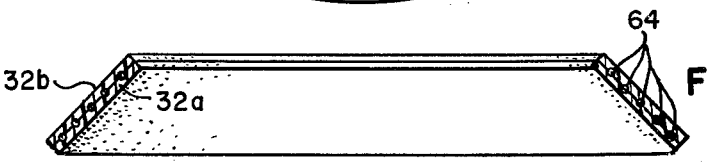

Referring to FIGS. 7–9, there is shown a modification of the invention, wherein a heating element comprising a grid of discrete wires 64 are coupled to leads 36*a* and 36*b*, by means of buses 66*a* and 66*b*, respectively.

Obviously, many other modifications and variations of the present invention are possible in the light of the above teachings, and, it is therefore understood that within the scope of the disclosed inventive concept, the invention may be practiced otherwise than as specifically described.

What is claimed is:

1. Housing apparatus comprising:

a window comprising a spherical segment and formed of material which is transmissive to radiation of selected frequencies, said window having a seating surface;

mounting means for providing forces to support said window and to resist external pressure applied to said window, said mounting means having a bearing surface for transmitting said supporting and said pressure resisting forces;

heated bearing gasket means abutting said bearing surface and also abutting said seating surface, said gasket means for transferring said supporting and said pressure resisting forces from said bearing surface of said mounting means to said seating surface of said window, and for transferring selected amounts of heat to said window;

heat regulating means coupled between said window and said gasket means for controlling the amount of heat transferred to said window by said gasket means; and holding means for maintaining said window, said mounting means and said gasket means in joined relationship.

2. The apparatus of claim 1 wherein said heated bearing gasket means comprises:

a load bearing gasket formed of selected elastic material for resisting wear between said bearing surface and said heating surface, said gasket having a first surface in abutting relationship with said bearing surface and a second surface in abutting relationship with said seating surface; and electric heating element means enclosed within said gasket and coupled to said regulating means for selectively heating said gasket.

3. The apparatus of claim 2 wherein:

said first surface of said gasket is shaped to abut a frustoconical bearing surface, and wherein said second surface of said gasket is shaped to abut a frustoconical seating surface.

4. The apparatus of claim 3 wherein said heat regulating means comprises:

thermometric means coupled to a surface of said window for providing a thermometric output which represents the temperature of said surface of said window; and thermostatically controlled voltage means receiving said thermometric output for coupling an electric current to said electric heating element means to maintain the temperature of said surface of said window within a selected temperature range.

5. The apparatus of claim 4 wherein:

said gasket comprises a first gasket component formed of electrically insulating, heat conductive gasket material, said first gasket component having a surface in abutting relationship with said frustoconical bearing surface, and further comprises a second gasket component formed of said gasket material, said second gasket component having a surface in abutting relationship with said frustoconical seating surface, said first and second gasket components having surfaces which are joined by means of a selected adhesive; and said electric heating element means comprises a selectively shaped strip of electrically conductive material enclosed between said first and said second gasket components, said strip being coupled to said voltage means.

6. The apparatus of claim 5 wherein said housing apparatus is capable of protecting equipment employed in a frigid marine environment, and wherein:

said window comprising a hyperhemispherical window;

said holding means includes compressible means adjacent to said window and to said mounting means for sealing said window against extreme external pressure on the order of several thousand psi; and said gasket receives said extreme pressure, said gasket comprising means for protecting said electric heating element means from said extreme pressure, and for resisting lateral wear between said bearing surface and said seating surface as said external pressure varies.

7. The apparatus of claim 6 wherein:

said thermometric means comprises a first temperature probe joined to the internal surface of said window;

said thermostatically controlled voltage means comprises means for coupling a selected amount of electric current to said electric heating element means to maintain the temperature of the external surface of said window at a temperature which is sufficiently high to prevent ice formation on the external surface of said window; and a second temperature probe joined to said gasket is coupled to said voltage means for operating said voltage means to prevent the temperature of said gasket from exceeding a selected upper limit.

8. The apparatus of claim 7 wherein:

said upper temperature limit is on the order of 200° F., and said first and second gasket components are formed of material which remains elastic after being heated to a temperature on the order of said upper limit.

9. The apparatus of claim 6 wherein:

said window is formed of material which is transmissive to radiation in the infrared frequency range; and said holding means comprises an external O-ring of compliant material which is compressed between said mounting means and the external surface of said window, an internal O-ring of compliant material which is compressed between said mounting means and the internal surface of said window, and a split ring having an outside edge which is shaped and dimensioned to match the inside curvature and inside dimensions of said hyperspherical window in proximity to said seating surface for compressing said external and internal O-rings to seal said window against external pressure upon said window, for resisting internal pressure within said window, and for maintaining said window, said mounting means, and said gasket in continuously joined relationship.

10. The apparatus of claim 6 wherein:

said window is formed of germanium;

said mounting means is formed of metallic material; and said first and second gasket components are formed of silicone rubber reinforced with fiberglass.

11. The apparatus of claim 6 wherein:

said window is formed of material which is transmissive to visible light.

12. Apparatus for housing equipment to be used by a submarine to view images of selected frequencies, said apparatus comprising:

a hyperhemispherical window formed of material which is transmissive to said images, said window having a seating surface;

mounting means for supporting said window, said mounting means having a bearing surface for transmitting supporting forces to said window;

an elastic gasket positioned between said seating surface and said bearing surface for transferring heat to said window and for resisting lateral wear between said seating surface and said bearing surface as the depth of said submarine in a marine environment varies;

means joined to said gasket for selectively heating said gasket; and holding means for joining said window and said mounting means, and for sealing said window from said marine environment as the depth of said submarine varies.

13. The apparatus of claim 12 wherein:

said heating means comprises means for heating said gasket to temperatures on the order of 200° F.; and a temperature control means is joined to said window and to said heating means for regulating said heating means, and for maintaining the temperature of the external surface of said window within a selected temperature above the freezing point of water when said submarine operates in a frigid marine environment.

* * * * *